US006092752A

United States Patent [19]

Heukamp et al.

[11] Patent Number: 6,092,752

[45] Date of Patent: Jul. 25, 2000

[54] ROTOR FOR IMPACTORS

[75] Inventors: Volker Heukamp, Lengerich; Gerhard Hemesath, Havixbeck, both of Germany

[73] Assignee: Noell Service und Machinentechnik GmbH, Langenhagen, Germany

[21] Appl. No.: 09/271,759

[22] Filed: Mar. 18, 1999

[30] Foreign Application Priority Data

Mar. 26, 1998 [DE] Germany ..... 198 13 310

[51] Int. Cl.[7] ..... B02C 13/02

[52] U.S. Cl. ..... 241/189.1; 241/191; 241/192; 241/195

[58] Field of Search ..... 241/189.1, 195, 241/197, 191, 192

[56] References Cited

U.S. PATENT DOCUMENTS

| | | | |
|---|---|---|---|
| 3,214,106 | 10/1965 | Gorman | 241/197 |
| 5,114,085 | 5/1992 | Inui | 241/195 |
| 5,221,054 | 6/1993 | Bergmann . | |
| 5,381,973 | 1/1995 | Hemesath . | |
| 5,392,999 | 2/1995 | Konig . | |

FOREIGN PATENT DOCUMENTS

| | | |
|---|---|---|
| 80 12 521 | 8/1980 | Germany . |
| 85 20 900 | 10/1985 | Germany . |
| 41 03 301 C2 | 11/1992 | Germany . |
| 41 02 692 C2 | 6/1994 | Germany . |
| 41 27 875 C2 | 3/1995 | Germany . |

*Primary Examiner*—John M. Husar
*Attorney, Agent, or Firm*—Michael J. Striker

[57] ABSTRACT

The invention relates to a rotor 1 for impactors, comprising a plurality of cast steel rotor discs 2, welded together at their widened flanges 3 that are touching one another and which feature a widened outer rim 4, which is interrupted by peripheral recesses 5 to accommodate blow bars. For improved accessibility to the retaining pieces 16 holding the blow bars in the blow bar holders, provision according to the invention is made for the sides of the partial sections 7 of the outer rims 4 to be tapered circumferentially in the direction opposite to the rotation direction of the rotor.

10 Claims, 2 Drawing Sheets

ROTOR FOR IMPACTORS

BACKGROUND OF THE INVENTION

The invention concerns a rotor for impactors comprising a plurality of cast steel rotor discs which are welded together at their widened touching hubs and featuring a widened outer rim which, compared with the hub is half as wide on both sides to provide the space necessary between adjacent outer rims to allow for insertion of a welding tool through to the hubs, and the outer rims of the rotor discs are interrupted by peripheral recesses in all rotor discs arranged in alignment with one another to form blow bar holders.

Such a rotor is known from U.S. Pat. No. 5,392,999, whereby U.S. Pat. No. 5,381,973 shows a further embodiment of this rotor in respect of the welding together of the rotor discs at their hubs.

As the first of the above documents in particular shows, the rotor is used in conjunction with blow bars which are pressed by wedges against supporting bodies and by means of ribs provided thereon together with corresponding grooves in the bars are thus secured against radial movement outwards resulting from centrifugal force. In this known rotor, the wedges are manipulated by hydraulic pressure elements and retained in the clamped position as described in U.S. Pat. No. 5,221,059. Blow bar changing is effected by releasing the wedges and withdrawing or pushing the blow bars axially from their holders, or also by removing the wedges and removing the blow bars radially from out of the peripheral recesses, for which purpose the rotor has to be rotated into such a position that the blow bar to be removed lies flat on its back. To do this, however, it must be lifted over the supporting body ribs, which are also designated as blow bar holder. The fitting of a new or even a turned blow bar is effected in the reverse sequence.

A rotor with hydraulic pressure elements is expensive and also susceptible to breakdown. Furthermore, the blow bars in the known rotor are not vertically removable, i.e. cannot be taken out from the top, since due to their extreme weight there are problems during removal of the wedges, also the pressure elements and the pressure line rails carrying them can be damaged.

Mechanically manipulated pressure elements like those known, for example, from DE-GM 80 12 521 and DE-GM 85 20 900, cannot be used with rotors of the generic type, since the widened outer rims do not allow access for such parts, in particular tools required for the tightening or loosening of such parts. Sometimes, mechanical pressure elements and their screw spindles or similar need to be removed by flame cutting. Such lack of accessibility is valid in particular to small and medium-sized rotors where, for cost reasons, mechanical pressure elements and retaining pieces respectively are needed specifically for those sizes.

SUMMARY OF THE INVENTION

The aim of the invention is to improve access to the gap between the neighbouring rotor discs of a rotor of the generic type and thus facilitate the use of mechanical pressure elements and retaining pieces in order to reduce fabrication and maintenance costs. This aim is achieved by tapering the sides of the partial sections of the outer rims formed circumferentially by the axis-parallel peripheral recesses in the direction opposite to the rotation direction of the rotor.

By tapering the partial sections of the outer rims, adequate space is created between adjacent rotor discs to allow retaining pieces to be fitted by hand and to use conventional tools for their fitting and removal. For this, it is advantageous for the taper to first commence from a section of the outer rim with parallel sides, which should be of adequately strong design to withstand the forces exerted on the outer rims through the blow bars, whereby the subsequent taper is designed to gradually assume the thickness of the rotor disc as a support.

In a further embodiment of the invention, the outer contour of the rotor discs formed by the outer rims and beginning with the maximum diameter essentially forms a curve with reducing diameter in the direction opposite to the rotating direction of the rotor inwardly towards the rotor centre. This design improves still further the accessibility of retaining pieces or similar located deeper within the rotor. This curve and the inward routing of the rotor disc contour is executed according to the penetration depth into the rotor of the material to be processed, so that the impact surface of the following blow bar is filly utilised, but at the same time wear along this contour is avoided, because the outer face of the rotor casing lies in the shadow of the forerunning blow bar.

To improve the durability, the invention further proposes that, to strengthen the rotor discs, thick web-like flanges are provided on the side surfaces of the rotor discs, running approximately radially from the partial sections of the outer discs through to the hubs, the height of the said flanges not protruding above the corresponding outer disc in the axial direction of the rotor.

According to the invention, a particularly uncomplicated rotor is created in that the peripheral recesses are inclined inwardly, starting from the outer circumference of the rotor in the direction opposite to the rotation direction of the rotor and thus overlapped by the partial sections of the outer rims to form a support for the blow bars.

The peripheral recesses advantageously feature at their front in the circumferential direction a further recess, one outwardly- orientated face of which runs parallel to and at a distance behind the sectional plane passing through the rotor axis, as well as a further, inner surface running approximately at rightangles to the outwardly-orientated face and serving as a base, and in which further recess is inserted a retaining piece, by means of which the blow bar in question is held against its corresponding support.

Even if it is obvious that the peripheral recesses of the rotor discs are matched to the blow bars to be accommodated therein, it is of inventive significance that the peripheral recesses for the blow bars feature an alignment corresponding to the vertical axis of each blow bar, and that the vertical axis runs at an angle $\alpha$ between 8° and 20°—preferably 13°—to the outwardly-orientated face of the further recesses.

Whereas known mechanical pressure elements are provided under the wedges within the rotor discs, the invention proposes that a flange be cast on both sides of the rotor discs underneath the further recess and approximately tangential to an imaginary rotor circle and/or parallel to the inner surface of the further recess, and that this flange is provided with a drilled hole which is in alignment with a hole drilled in the retaining piece, and that these drilled holes have a screw connection for securing the retaining piece to the rotor body. Since such a flange and such a screw connection are provided on each side of the particular rotor disc, the retaining piece is particularly secure. As screw connection, simple bolts, e.g. cheese-head bolts with nuts can be used, which are easily removable by flame cutting as necessary.

Thanks to the space created by the invention between the rotor discs and in front of the blow bars, these screw connections are also accessible for power-operated screwdrivers. Even so, the screw connections are protected against wear by the corresponding forerunning blow bar or forerunning partial section of the outside rims.

The design of the blow bar support according to the invention in respect of its vertical axis which inclines inwardly opposite to the rotation direction of the rotor and in conjunction with the retaining pieces arranged in front of the blow bars provides without any additional thrust forces a more than ample blow bar seating with no stress reversal, the advantage of this being that the contact surfaces of retaining pieces, blow bars and supporting bodies cannot move or become otherwise deformed.

Should a retaining piece become jammed, the design according to the invention of the outwardly-orientated surface of the further recess is such that this surface is bevelled in the axial direction of the rotor, this bevel and that of the associated retaining piece featuring a self-locking angle of 5° to the axial direction which provides the facility of easily releasing the retaining piece by application of a hammer blow to the retaining piece in the widening direction of the bevel.

BRIEF DESCRIPTION OF THE DRAWING

In the drawing, the invention is illustrated as follows.

DESCRIPTION OF THE PREFERRED EMBODIMENTS

Figure 1:
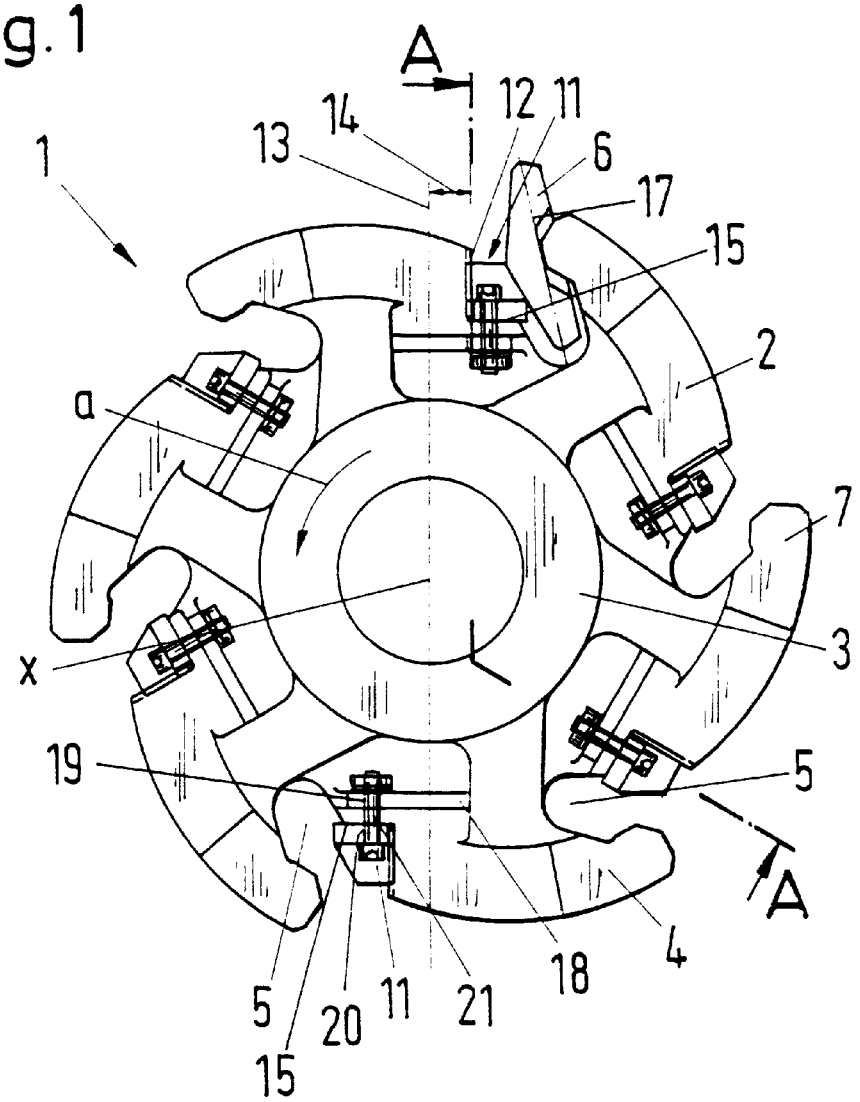
FIG. 1 is a face view of a rotor for an impactor according to the invention

The illustrated rotor 1 comprises a plurality of cast steel rotor discs 2 welded together at their widened hubs 3 which are touching each other. The rotor discs 2 feature a widened outer rim 4 which, compared with the hub 3 is half as wide on both sides as the distance necessary between adjacent outer rims 4 for the insertion of a welding tool to the hubs 3. In other words, the outer rims are spaced at a distance from each other.

They are interrupted by peripheral recesses 5, FIG. 1, which extend into the rotor discs 2. The peripheral recesses of all rotor discs are in alignment with one another and form holders for blow bars 6, see FIG. 2. Through the peripheral recesses, the outer rims 4 are divided into partial sections 7, the sides of which are tapered circumferentially in the direction opposite to the rotation direction according to arrow a; FIG. 3 arrow b shows such a taper. However, the taper does not immediately commence at the particular peripheral recess, rather the sides 9 of the outer rims 4 run parallel initially, as a consequence of which design appropriate stability is provided to withstand the forces from the blow bars 6 acting on the outer rims 4, as shown in FIG. 3. The subsequent taper of partial sections 7 of the outer rims 4 is designed as a support, gradually assuming the thickness of the rotor disc, see FIGS. 1 and 3.

As FIG. 1 clearly shows, the outer contour of the rotor discs 2 starts with a maximum diameter and runs opposite to the rotation direction of the rotor to the next peripheral recess, essentially describing a reducing curve inwards towards the centre of the rotor.

The peripheral recesses 5 are, as further shown in FIG. 1, inwardly inclined, starting from the outer circumference of the rotor 1 and running opposite to the rotation direction of the rotor arrow a and are overlapped by the partial sections 7 of the outer rims 4, so that they form a support for the blow bars 6.

As further apparent from FIG. 1, each peripheral recess 5 features at its front in the circumferential direction a further recess 11 with one outwardly-orientated surface 12 running parallel to a sectional plane 13 passing vertically through rotor axis x and at a distance 14 behind the sectional plane in the circumferential direction. Arranged at approximate rightangles to this outwardly-orientated surface 12 is a further surface 15 forming a base. In this further recess 11 thus designed is fitted a retaining piece 16, with which the inserted blow bar 6 is held against the corresponding support.

Figure 2:
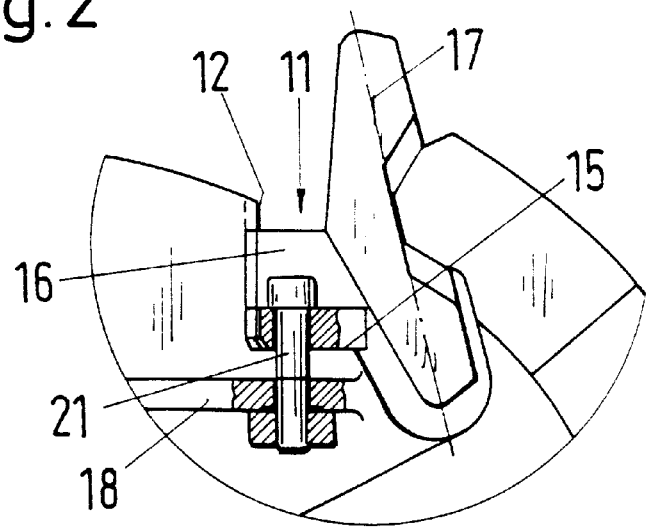
FIG. 2 is a large-scale section of the rotor.
Figure 3:
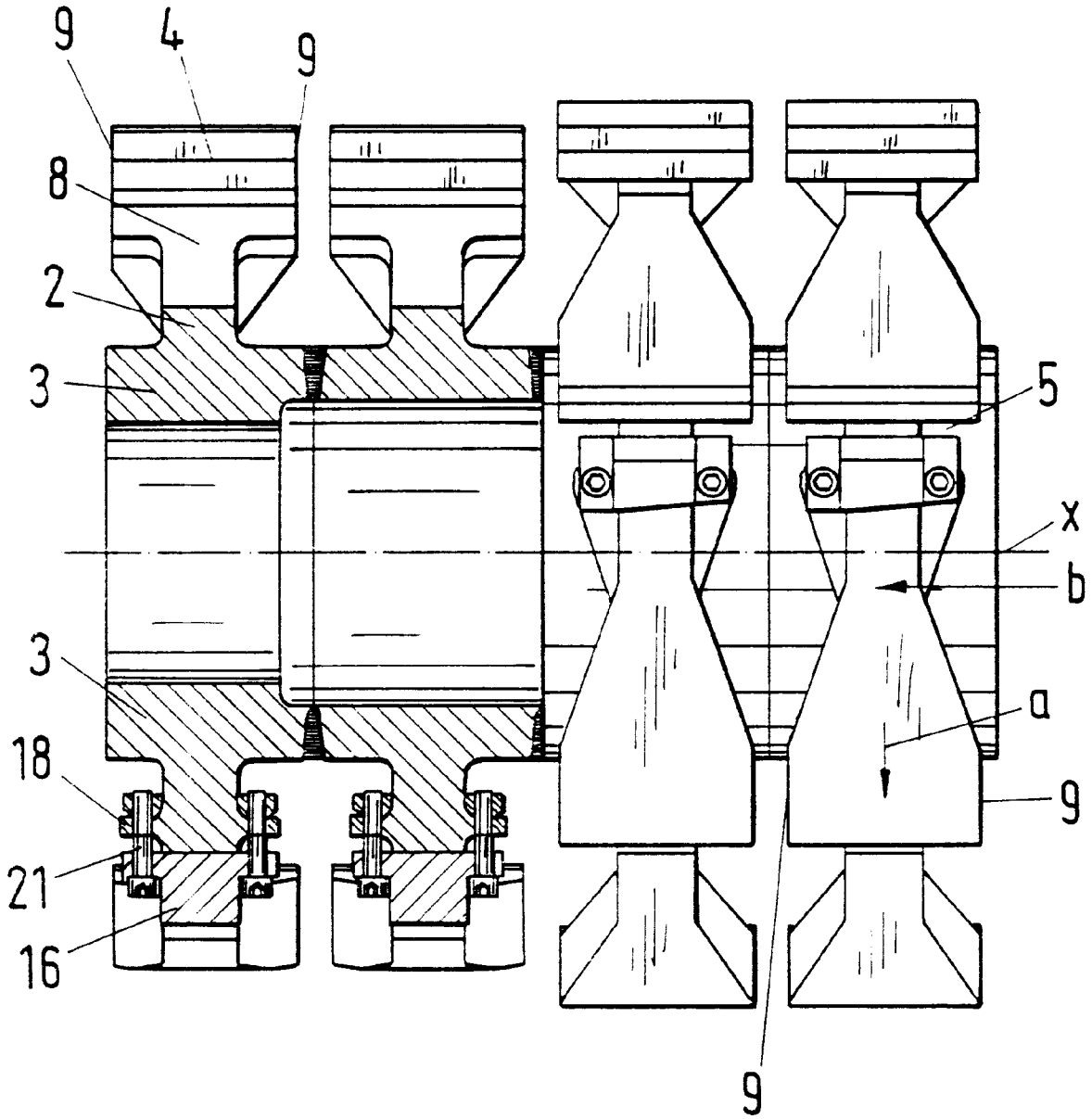
FIG. 3 is a side and part-section view of a rotor according to the invention corresponding to a line of intersection A—A in FIG. 1, half-side and half-side lateral view.

The position of blow bars 6 in the peripheral recesses 5 is shown in FIGS. 1 and 2. The peripheral recesses are provided in the direction of their bases with an alignment corresponding more or less with the alignment of the vertical axis 17 running through the blow bars, whereby the vertical axis is at an acute angle of some 8° to 20°—preferably 13°—to the outwardly-orientated surface 12 and to the vertical sectional plane running parallel thereto through the rotor axis, with an alignment of the rotor according to FIG. 1.

As this figure further shows, underneath each further recess 11 and running more or less at a tangent to an imaginary rotor circle and parallel to the inner face 15 of the further recess 11 is a cast-on flange 18 with drilled hole 19, which hole lines up flush with a drilled hole 20 in the retaining piece. Inserted into the drilled holes is a screw connection 21, by means of which the retaining piece is secured to the rotor body. Such a fixing device is provided on both sides of the rotor discs 2, see also FIGS. 2 and 3.

To facilitate the removal of the retaining pieces 16, the outwardly-orientated surface 12 of the further recess 11 is slanted in the axial direction of the rotor 1, whereby in connection with a correspondingly sloped face on the retaining pieces 16 a wedge effect is produced, which is less to serve the wedging of the blow bars than to simplify the removal of the retaining pieces, should these have become jammed, FIG. 2.

As emerges from the description in conjunction with the drawing, this creates a rotor, the blow bars of which are securely held by simple and easy manipulation of the blow bar retaining means. In particular, easy access to these means is provided.

What is claimed is:

1. A rotor for impactors, comprising a plurality of steel cast rotor disks provided with hubs which are welded to one another and with outer rims being narrower than said hubs so as to form gaps between adjacent ones of said outer rims, each of said outer rims of a respective one of said rotor disks being provided with a plurality of peripheral recesses so as to form partial sections therebetween, each of said partial sections of said rims tapering circumferentially at both sides in a direction which is opposite to a direction of rotation of the rotor.

2. A rotor as defined in claim 1, wherein each partial section of each of said rims has a portion provided with parallel sides and has a robust design for withstanding forces from blow bars acting on said outer rims, each of said sections having a taper which starts from said portion with parallel sides, and a subsequent taper formed to gradually assume a thickness of a respective one of said rotor disks to act as a support.

3. A rotor as defined in claim 1, wherein each of said rotor disks has an outer contour formed by said outer rim and starting with a maximum diameter and running opposite to said direction of rotation to a following one of said peripheral recesses so as to describe substantially a reducing curve inward toward a center of the rotor.

4. A rotor as defined in claim 1; and further comprising web-shaped reinforcing flanges which are provided on lateral surfaces of said rotor disk from said partial sections of said outer rims through to said hubs and running substantially radially, said web-shaped reinforcing flanges having heights which do not protrude above a corresponding one of said outer rims in an axial direction of the rotor.

5. A rotor as defined in claim 1, wherein said peripheral recesses starting at an outer circumference of the rotor are inwardly inclined opposite to said direction of rotation and are overlapped by partial sections of said outer rims so as to form a support for the blow bars.

6. A rotor as defined in claim 5, wherein said outwardly oriented surface of said further recess is sloped in an axial direction of the rotor to form a slope, said slope and an associated one of said retaining pieces being arranged at an angle of substantially 5° to the axial direction.

7. A rotor as defined in claim 1, wherein each of said rotor disks has a further recess located in front of said first mentioned peripheral recess in a circumferential direction and having an outwardly oriented surface which runs parallel to a sectional plane passing through a rotor axis and at a distance behind the sectional plane in the circumferential direction, each of said further recesses also having a further inner surface which is arranged substantially at a right angle to said outwardly oriented surface and acting as a base; and further comprising a retaining piece inserted in said further recess for holding the blow bar.

8. A rotor as defined in claim 7; and further comprising blow bars inserted in said peripheral recesses and having longitudinal axes, each of said peripheral recesses being aligned to said longitudinal axis of each of said blow bars, said longitudinal axis extending at an angle of 8°–20° to said outwardly oriented surface of said further recess.

9. A rotor as defined in claim 8, wherein said longitudinal axis of each of said blow bars extends at an angle of 13° to said outwardly oriented surface of said further recess.

10. A rotor as defined in claim 7, wherein said retaining piece has a hole, each of said rotor disks being provided with a cast-on flange located underneath of each of said further recesses and running substantially at a tangent to an imaginary rotor circle and parallel to an inner face of a respective one of said further recesses on both sides of said rotor disk, each of said cast-on flanges having a drilled hole which lines up flush with said drilled hole of said retaining piece; and further comprising a screw connection received in said drilled hole of said cast-on flange and said drilled hole of said retaining piece to secure said retaining piece.

* * * * *